US007135225B2

(12) United States Patent
Yoshimura et al.

(10) Patent No.: US 7,135,225 B2
(45) Date of Patent: Nov. 14, 2006

(54) ACRYLIC SYNTHETIC FIBER IMPROVED IN STYLEABILITY

(75) Inventors: Satoru Yoshimura, Akashi (JP); Kazuaki Fujiwara, Himeiji (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 10/522,759

(22) PCT Filed: Jul. 14, 2003

(86) PCT No.: PCT/JP03/08942

§ 371 (c)(1),
(2), (4) Date: Aug. 9, 2005

(87) PCT Pub. No.: WO2004/013389

PCT Pub. Date: Feb. 12, 2004

(65) Prior Publication Data

US 2005/0287365 A1 Dec. 29, 2005

(30) Foreign Application Priority Data

Aug. 1, 2002 (JP) ..... 2002-225317

(51) Int. Cl.
*D01F 6/00* (2006.01)

(52) U.S. Cl. ..... 428/364; 428/394; 446/394

(58) Field of Classification Search ..... 428/364, 428/394; 446/394
See application file for complete search history.

(56) References Cited

U.S. PATENT DOCUMENTS 3,839,081 A * 10/1974 Tanahashi et al. ..... 442/102
3,953,651 A * 4/1976 Sone et al. ..... 428/391
4,048,371 A * 9/1977 Brumlik ..... 428/375
4,076,329 A * 2/1978 Johnson et al. ..... 303/56
5,502,090 A * 3/1996 Matsunase et al. ..... 524/3
6,696,156 B1 * 2/2004 Kasabo et al. ..... 428/400
6,770,364 B1 * 8/2004 Murata et al. ..... 428/364

FOREIGN PATENT DOCUMENTS

| | | |
|---|---|---|
| EP | 0 292 907 A2 | 11/1988 |
| JP | 55-158322 | 12/1980 |
| JP | 56-063006 | 5/1981 |
| JP | 58-004809 | 1/1983 |
| JP | 1-148806 | 6/1989 |
| JP | 02182915 A * | 7/1990 |
| WO | WO 02/061187 A1 | 8/2002 |

* cited by examiner

*Primary Examiner*—N. Edwards
(74) *Attorney, Agent, or Firm*—Kenyon & Kenyon LLP

(57) ABSTRACT

An object of the present invention is to provide an acrylic synthetic fiber having excellent stylability and heat resistance. The object may be attained by an acrylic synthetic fiber having a knot-like unevenness on a fiber surface thereof, a difference of distances between a depression and a projection of 5.0 micrometers to 15.0 micrometers, a distance between peaks of unevenness of 0.05 mm to 0.5 mm, a flexural rigidity value of the fiber of $7.0\times10^{-7}$ N-m$^2$/m to $10.0\times10^{-7}$ N-m$^2$/m, and a torsional rigidity value of the fiber of $5.0\times10^{-9}$ N-m$^2$ to $10.0\times10^{-9}$ N-m$^2$, and furthermore the object may be attained by an acrylic synthetic fiber comprising an acrylic copolymer having a content of acrylonitrile of not less than 60 mol %, a sulfur content originating in a vinyl based monomer including a sulfonic group of 0.15% by weight to 0.50% by weight, and a specific viscosity of 0.20 to 0.50.

7 Claims, 3 Drawing Sheets

ACRYLIC SYNTHETIC FIBER IMPROVED IN STYLEABILITY

This is a 371 national phase application of PCT/JP2003/008942 filled 14 Jul. 2003, claiming priority to Japanese Application No. 2002-225317 filed 1 Aug. 2002, the contents of which are incorporated herein by reference.

FIELD OF THE INVENTION

The present invention relates to a fiber for artificial hair used for wigs, hairpieces, extension hairs (weavings), hair for dolls, etc., and to a fiber for hair having excellent stylability and heat resistance.

BACKGROUND ART

In general, a large number of fibers, such as, acrylic fibers, vinyl chloride based fibers, and polyamide fibers, or polyester fibers are marketed as artificial fibers for hair. However, since these fibers are not simultaneously provided with all characteristics necessary as an artificial fiber for hair, such as heat resistance, curling property, and touch, each material has limited advantageous style fields for wigs. For example, conventional fibers are classified into synthetic fibers suitable for curly style, or synthetic fibers suitable for straight style, respectively, and since only a few synthetic fibers having wide stylability (fiber function enabling various styles for wigs) are marketed, development of such synthetic fibers are now demanded. For this reason, in order to improve stylability, for example, Japanese Patent Laid-Open No. 55-158322 official report, Japanese Patent Laid-Open No. 56-63006 official report, and Japanese Patent Laid-Open No. 58-4809 official report disclose techniques for accomplishing objects thereof by giving specific unevenness to a fiber surface. Although application of specific unevenness to a fiber surface is effective method for improvement in stylability, indeed, only application of simple surface unevenness cannot improve rigidity of the fiber, and, as a result, cannot sufficiently satisfy salability of straight style. Low heat resistance thereof does not allow use of thermal instruments, such as hair driers, and does not easily enable creation of hair style suitable for taste of each individual, and therefore many users require improvement in the point.

SUMMARY OF THE INVENTION

The present invention relates to providing a fiber bundle for artificial hair, for solving the problems, and for use of wigs, hairpieces, extension hairs (weaving), hair for dolls, etc. by an acrylic synthetic fiber having a knot-like unevenness on a fiber surface thereof, and having flexural rigidity and torsional rigidity values within a specific range. Moreover, the present invention relates to providing a fiber for artificial hair having excellent stylability and heat resistance.

The present inventors found out that application of a knot-like unevenness onto a fiber surface of an acrylic synthetic fiber comprising an acrylic copolymer, and limitation of flexural rigidity and torsional rigidity of the fiber within a specific range could solve the problem.

That is, the present invention relates to an acrylic synthetic fiber having a knot-like unevenness on a fiber surface thereof, a difference of distances between a depression and a projection of 5.0 micrometers to 15.0 micrometers, a distance between peaks of unevenness of 0.05 mm to 0.5 mm, a flexural rigidity value of the fiber of $7.0\times10^{-7}$ N-m$^2$/m to $10.0\times10^{-7}$ N-m$^2$/m, and a torsional rigidity value of the fiber of $5.0\times10^{-9}$ N-m$^2$ to $10.0\times10^{-9}$ N-m$^2$.

Preferably the fiber is an acrylic synthetic fiber comprising an acrylic copolymer having a content of acrylonitrile of not less than 60 mol %, a sulfur content originating in a vinyl based monomer including a sulfonic group of 0.15% by weight to 0.50% by weight, and a specific viscosity of 0.20 to 0.50 in the acrylic copolymer.

It is preferable that 10% shrinkage starting temperature of the acrylic synthetic fiber is not less than 150 degrees C.

It is preferable that an artificial hair consists of the acrylic synthetic fiber.

The present invention will, hereinafter, be described in detail. The present invention relates to an acrylic synthetic fiber having a knot-like unevenness on a fiber surface thereof, a difference of distances between a depression and a projection of 5.0 micrometers to 15.0 micrometers, a distance between peaks of unevenness of 0.05 mm to 0.5 mm, a flexural rigidity value of the fiber of $7.0\times10^{-7}$ to $10.0\times10^{-7}$ N-m$^2$/m, and a torsional rigidity value of $5.0\times10^{-9}$ to $10.0\times10^{-9}$ N-m$^2$.

Acrylic synthetic fiber as used in the present invention has a knot-like unevenness and a difference of distances between a depression and a projection of 5.0 micrometers to 15.0 micrometers (difference of depressed area of fiber surface and projected area) on a fiber surface, and preferably 6.0 micrometers to 12.0 micrometers, as shown in FIG. 1. Moreover, it has a distance between peaks of unevenness of 0.05 mm to 0.5 mm (distance of a projected area on surface of fiber, and a neighboring projected area), and preferably 0.06 mm to 0.40 mm. A difference of distances between a depression and a projection of less than 5.0 micrometer cannot give intended stylability, and a difference exceeding 15.0 micrometers gives severe frictional property onto a surface of the fiber, resulting in occurrence of troubles, such as yarn breakage in a processing process of wigs. Moreover, a distance between peaks of unevenness of less than 0.05 mm gives severe frictional property on a surface of the fiber, and occurs troubles, such as yarn breakage in a processing process of wigs, and a difference exceeding 0.5 mm cannot give intended stylability. An acrylic synthetic fiber of the present invention has a flexural rigidity value of $7.0\times10^{-7}$ to $10.0\times10^{-7}$ N-m$^2$/m, preferably $7.0\times10^{-7}$ to $9.0\times10^{-7}$ N-m$^2$/m, and more preferably $7.5\times10^{-7}$ to $8.5\times10^{-7}$ N-m$^2$/m. A flexural rigidity value of less than $7.0\times10^{-7}$ N-m$^2$/m gives weak flexural rigidity, and insufficient stylability to the fiber, and a flexural rigidity exceeding $10.0\times10^{-7}$ N-m$^2$/m hardens touch of the fiber, and makes the fiber unsuitable as an artificial hair.

Moreover, an acrylic synthetic fiber of the present invention has a torsional rigidity value of not more than $5.0\times10^{-9}$ to $10.0\times10^{-9}$ N-m$^2$, preferably $5.0\times10^{-9}$ to $9.6\times10^{-9}$ N-m$^2$, and more preferably $5.0\times10^{-9}$ to $9.3\times10^{-9}$ N-m$^2$. A torsional rigidity value less than $5.0\times10^{-9}$ N-m$^2$ weakens torsional rigidity of the fiber, and gives insufficient stylability, and a torsional rigidity value exceeding $10.0\times10^{-9}$ N-m$^2$ hardens touch of the fiber, making the fiber unsuitable as an artificial hair.

In measurement of the flexural rigidity and torsional rigidity of a fiber as used in the present invention, a bending moment is measured based on a repulsive force in each curvature of an acrylic synthetic fiber being bent using a flexural rigidity measurement machine (KES-FB2-S, made by Kato Tech Co., Ltd.), as described later. Moreover, in measurement of the torsional rigidity, using a torsional rigidity measurement machine (KES-YN1, made by Kato Tech Co., Ltd.), a torsional moment is measured based on a repulsive force of a rotated acrylic synthetic fiber.

A content of acrylonitrile in an acrylic copolymer constituting an acrylic synthetic fiber of the present invention is preferably not less than 60 mol %, and more preferably not less than 65 mol %. An upper limit is preferably 90 mol %, and more preferably 85 mol %. There is shown a tendency for a content of acrylonitrile of less than 60 mol % to make insufficient heat resistance of the acrylic synthetic fiber. Moreover, there is shown a tendency for a content of acrylonitrile exceeding 90 mol % to impair touch and flame resistance that is an advantageous feature of an acrylic synthetic fiber. Heat resistance required by the present invention means durability of an acrylic synthetic fiber over heat of a drier, and in this point, the acrylic synthetic fiber preferably has a 10% shrinkage starting temperature of not less than 150 degrees C., and more preferably not less than 155 degrees C. A 10% shrinkage starting temperature of less than 150 degrees C. induces curl and welding by shrinkage of a fiber, and there is shown a tendency of reduction of commodity value. Moreover, an upper limit value of 10% shrinkage starting temperature is preferably 180 degrees C. Although the temperature exceeding 180 degrees C. improves heat resistance, there is shown a tendency for curl-set hard to be given. Here, a 10% shrinkage starting temperature means a temperature obtained by a following method. First, a fiber bundle is heat-treated under conditions of arbitrary temperature and unstrained for 30 minutes, and a sample length LD (mm) after cooling to a room temperature is measured. A dry heating shrinkage percentage to the sample length before heat treatment L (mm) is determined by a following equation. Next, extrapolation is performed in relation to each temperature and dry heating shrinkage percentage to obtain a 10% shrinkage starting temperature (T10).

$$\text{Dry heating shrinkage percentage (\%)}=[L\ (20.0\ \text{cm})-LD]/L\ (20.0\ \text{cm})]\times 100$$

Moreover, an acrylic copolymer constituting an acrylic synthetic fiber of the present invention uses a vinyl monomer including a sulfonic group as a copolymerizable component. Preferably, the percentage to be used is set so that a sulfur content originating in a vinyl based monomer including a sulfonic group in the acrylic copolymer may be 0.15% by weight to 0.50% by weight, and more preferably 0.20% by weight to 0.40% by weight. A sulfur content less than 0.15% by weight of originating in vinyl based monomer including a sulfonic group is prone to make difficult development of pores in a fiber necessary for applying unevenness to a surface of the fiber, and to reduce dye affinity, as described later. And the sulfur content exceeding 0.50% by weight may not improve effects of the present invention, and causes cost disadvantage.

Moreover, a specific viscosity of an acrylic copolymer is a factor that controls flexural rigidity and torsional rigidity of the fiber. The specific viscosity concerned is preferably 0.20 to 0.50, more preferably 0.22 to 0.45, and still more preferably 0.25 to 0.40. A specific viscosity less than 0.20 reduces flexural rigidity and torsional rigidity, and shows a tendency for desired stylability not to be given. A specific viscosity exceeding 0.50 excessively raises a viscosity of a spinning solution obtained by dissolving the acrylic copolymer in a solvent, and disadvantageously shows a tendency of poor productivity.

Here, the specific viscosity as used herein is obtained by measuring a polymer solution of (an acrylic copolymer 2 g/dimethylformamide 1 L) for a viscosity at 30 degrees C. with an Ostwald type viscometer.

Hereinafter, descriptions will be given about general method for manufacturing an acrylic synthetic fiber of the present invention.

As methods, and devices, etc. for manufacturing an acrylic copolymer used in order to manufacture an acrylic synthetic fiber, general well-known polymerization methods and after-treatment methods may be used.

As copolymerizable components for acrylonitrile, vinyl monomers including halogen, mono-olefine based monomers, etc. may be mentioned, and when a content of the acrylonitrile in the acrylic copolymer is not less than 60 mol %, well-known vinyl monomers may be used. The vinyl monomers including halogen are especially effective as a component for giving flame resistance to the acrylic copolymer as a fiber. Such vinyl monomers including halogen are not especially limited, as long as they are copolymerizable with acrylonitrile. As the vinyl monomers including halogen, for example, but not limited to, vinylidene chloride, vinyl chloride, vinylidene bromide, vinyl bromide, etc. may be mentioned. Vinylidene chloride and vinyl chloride are preferable in respect of easy availability among them. Moreover, other mono-olefine based monomers copolymerizable with them may be used in a level not adversely affecting the present invention. As other mono-olefin monomers, for example, but not limited to, acrylic acid, methacrylic acid and esters thereof, acrylamide, vinyl acetate, etc. may be mentioned. Methyl acrylate and methyl methacrylate are preferable in respect of excellent reactivity and improvement in dye affinity among them.

Moreover, as vinyl based monomer including a sulfonic group, there may be mentioned, for example, but not limited to, sodium para-styrenesulfonate, sodium methallylsulfonate, sodium isoprene sulfonate(2-methyl-1,3-butadiene-1-sodium sulfonate), 2-acrylamido-2-sodium methyl propane sulfonate(acrylamide-t-butyl-sodium sulfonate), para-styrene sulfonic acid, methallyl sulfonic acid, isoprene sulfonic acid (2-methyl-1,3-butadiene-1-sulfonic acid), 2-acrylamido-2-methyl propane sulfonic acid (acrylamide-t-butyl-sulfonic acid) etc. From points of the easy availability, and excellent reactivity among them, sodium para-styrenesulfonate, sodium isoprene sulfonate or sodium methallylsulfonate, 2-acrylamido-2-methyl propane sulfonic acid (acrylamide-t-butyl-sulfonic acid) are preferable.

Following methods may be mentioned as preferable methods for developing a knot-like unevenness on a surface of the acrylic synthetic fiber. In case of using an acrylic copolymer soluble in acetone, an acrylic copolymer having a content of acrylonitrile of not less than 60 mol % is dissolved in acetone as a solvent to obtain a a spinning solution having 20% to 35% by weight, preferably 25% to 32% by weight of resin concentration. A value of viscosity (for 12 rpm and 30 seconds) of the spinning solution measured with a Brookfield viscometer manufactured by TOKIMEC is preferably not less than 40 poise at 40 degrees C. to 50 degrees C., and more preferably 50 poise to 70 poise. A manufacturing process is performed by wet spinning method using the spinning solution. In a range of not adversely affecting the present invention, other additives, such as ultraviolet absorbers, may be used in the spinning solution.

A hole shape of a nozzle used herein may have a round shape, a dumbbell type, or a ★ shape, but it is not especially limited to them. A nozzle draft (a nozzle draft designates a ratio of extruding velocity of a spinning solution from the nozzle hole and a taking up velocity) is a factor that controls a difference of distances between a depression and a projection and a distance between peaks of unevenness on a surface of the acrylic synthetic fiber. For example, a nozzle draft when using a non-circular nozzle having the above described ★ type is preferably at least 0.7, and more preferably in a range of 0.80 to 1.3. A nozzle draft less than 0.7 disadvantageously makes smaller a difference of distances between a depression and a projection on a surface of the resulting acrylic synthetic fiber obtained, and furthermore enlarges a distance between peaks of unevenness.

A coagulation bath is of an aqueous solution of acetone and is preferably adjusted to 30% by weight to 50% by weight of acetone concentration, and 15 degrees C. to 30 degrees C. of a bath temperature, and more preferably 35% by weight to 40% by weight of acetone concentration, and 20 degrees C. to 25 degrees C. of a bath temperature. Spinning carried out under this condition can give pores to a cross section of the acrylic synthetic fiber. Conditions out of the range of the coagulation bath cannot give pores to a cross section of the acrylic synthetic fiber, and as a result, there is shown a tendency for surface unevenness obtained by pores collapsed by drying not to be formed. The obtained yarn is washed with water, dried with wet heated wind at a temperature of not less than 100 degrees C. and a wet-bulb temperature of not less than 60 degrees C., and lost transparency recovery treatment is given. After the yarn is stretched, the yarn is heat treated to obtain an acrylic synthetic fiber. At this time, a treatment by 5% to 30% of relaxation percentage can reduce a heat shrinkage rate thereof. When a relaxation percentage is out of the range, there is shown an unpreferable tendency for quality as a fiber for artificial hair to be deteriorated. Besides, a size of a fiber of the acrylic synthetic fiber of the present invention is preferably 25 decitexes to 75 decitexes, and more preferably 40 decitexes to 60 decitexes. There is shown a tendency for a size of a fiber of the acrylic synthetic fiber less than 25 decitexes to weaken retentivity of curl, and a size of a fiber exceeding 75 decitexes to increase rigidity, impairing stylability as an artificial hair. As a cross section shape of the acrylic synthetic fiber, a horseshoe type, a dumbbell type, a round shape, etc. are preferable, but it is not limited to them.

In case of using an acrylic copolymer having a high content of acrylonitrile, a target fiber may be obtained by methods shown hereinafter. The acrylic copolymer is dissolved in solvents, such as dimethylformamide (DMF) and dimethylacetamide (DMAc) to obtain a spinning solution concentration of 20% to 35% by weight. The spinning solution is extruded into a coagulation bath including an aqueous solution of a solvent such as DMF and DMAc, having a bath temperature adjusted at 15 degrees C. to 35 degrees C. and a concentration of DMF or DMAc adjusted to 30% by weight to 90% by weight, with a nozzle draft of 0.5 to 1.2, using a round shape or a non-circular nozzle with ★ shape. Then the yarn extruded is processed by well-known methods. Here, an acrylic copolymer having a high content of acrylonitrile designates an acrylic copolymer having a content of acrylonitrile of 70 mol % to 90 mol % in the acrylic copolymer.

The acrylic synthetic fiber obtained in the above-described methods is used for headdress products, such as wigs, hairpieces, extension hairs (weavings), and hair for dolls, using well-known methods.

BEST MODE FOR CARRYING-OUT OF THE INVENTION

Figure 1:
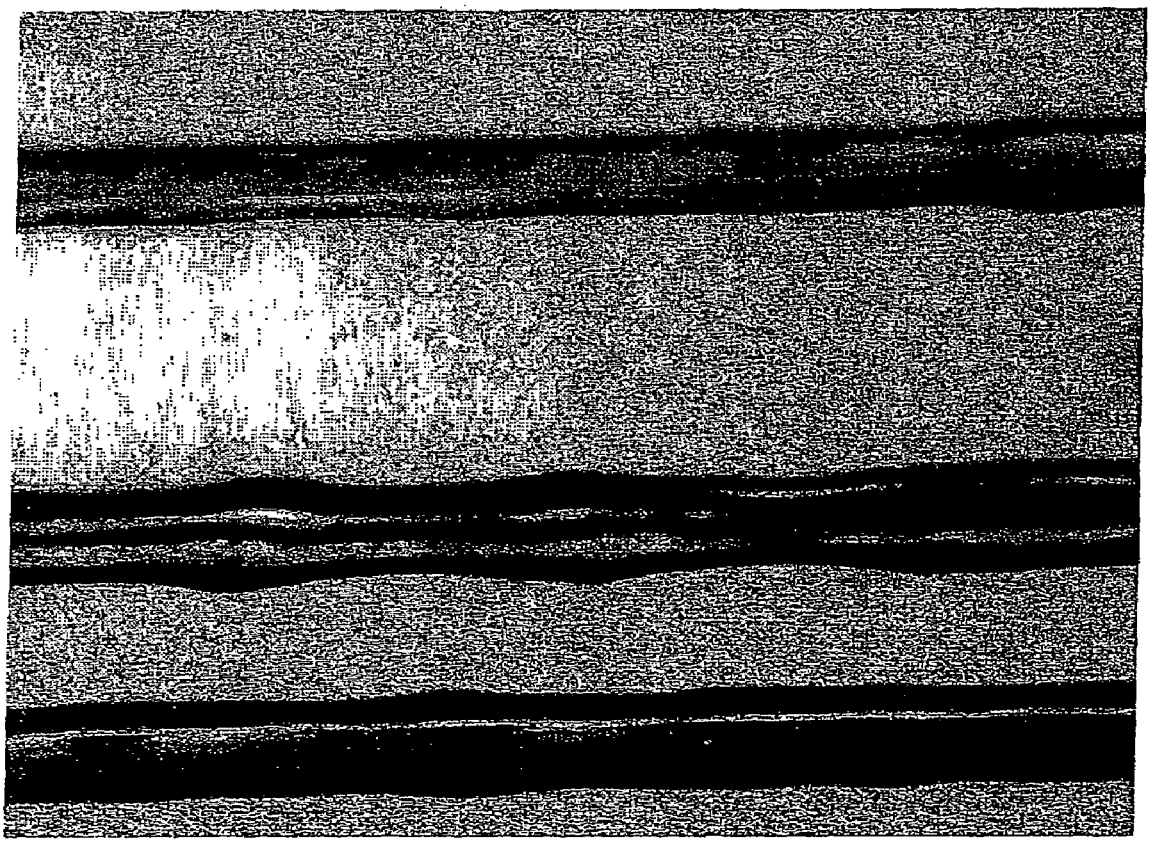
FIG. 1 is a photograph showing a surface unevenness of an acrylic synthetic fiber in Example 1.

Although descriptions will, hereinafter, be given in more detail with reference to Examples, the present invention is not limited to the Examples. Besides, descriptions about definitions of measuring methods etc. will be given in advance of Examples. (Method for measuring a sulfur content originating in a vinyl based monomer including a sulfonic group)

Measurement of a sulfur content originating in vinyl monomer including a sulfonic group was carried out using a following method. A resin of an acrylic copolymer 0.1 g was burned under conditions of an atmosphere of argon/oxygen=100/100, a heating temperature of 900 degrees C., and a heating period of time 35 minutes to obtain a combustion gas, using a sample combustion apparatus (QF-02, made by Mitsubishi Chemical Corporation). The gas was absorbed in 0.3% by weight of hydrogen peroxide aqueous solution to obtain sulfate ion. The sulfate ion was analyzed using an ion chromatography (IC-7000, made by Yokogawa Analytical Systems Inc.), and then a sulfur content was calculated from a content of the sulfate ion. Next, a sulfur content originating in an polymerization initiator is deducted from the obtained value, and thus a sulfur content of the vinyl based monomer including a sulfonic group origin was calculated. Besides, a sulfur content originating in the polymerization initiator was calculated by a same method using an acrylic copolymer including no vinyl monomer including a sulfonic group.

(Method for Measuring a Resin Composition)

In the method, a nitrogen content in a resin was measured using a CHN Corder (made by Yanaco, Inc.), and then an acrylonitrile content was calculated using the nitrogen content as a nitrogen content originating in acrylonitrile.

(Method for Measuring a Specific Viscosity)

A specific viscisity was measured for a polymer solution of (acrylic copolymer 2 g)/(dimenthylformamide 1L) at 30 degrees C. using an Ostwald type viscometer.

(Method for Measuring a Viscosity of a Spinning Solution)

A viscosity (for 12 rpm and 30 seconds) was measured at 40 degrees C. using a Brookfield viscometer (made by TOKIMEC Corp.)

(Method for Measuring a Surface Unevenness)

A fiber was observed for a difference of distances between a depression and a projection and a distance between peaks of unevenness using an optical microscope with 100 times of magnification, and calculation was performed.

(Method for Measuring a Flexural Rigidity)

In the method, using a flexural rigidity measuring machine (KES-FB2-S, manufactured by Kato Tech Co., Ltd.), measurement was performed for a sample obtained by arranging 49 units of acrylic synthetic fibers with a length of 1 cm at intervals of 1 mm, under a condition of bending curvature of ±2.5 cm, and then an average value was calculated for 3 times of measurements to obtain a flexural rigidity value (unit: $N\text{-}m^2/m$).

(Method for Measuring a Torsional Rigidity)

A sample with a length of 2 cm was measured for a torsional rigidity under conditions of a twist number of rotations of ±3 revolutions, and a twist speed of 12 degree/second, using a torsional rigidity measurement machine (KES-YN1, made by Kato Tech Co., Ltd.), and then an average value was calculated for 10 times of measurements to obtain a torsional rigidity (unit: $N\text{-}m^2$)

(Method Measuring a Dry Heating Shrinkage Percentage)

A fiber bundle was heat-treated under conditions of arbitrary temperature and unstrained for 30 minutes, and then a sample length LD (mm) after cooling to a room temperature was measured. A dry heating shrinkage percentage might be obtained for shrinkage percentage of the sample length LD (mm) to a sample length L (mm) before heat treatment by a following equation. Moreover, from a relationship between temperatures and dry heating shrinkage percentages, a 10% shrinkage starting temperature was calculated by extrapolation, and defined as T10.

$$\text{Dry heating shrinkage percentage (\%)}=[L\ (20.0\ \text{cm})-LD]/L(20.0\ \text{cm})]\times 100$$

(Method for Evaluating Stylability)

A pageboy style was formed, and the style was evaluated for retentivity of curl, stability of curl, bulkiness, and set of a surface by five common engineers engaged in cosmetics evaluation of wigs etc. Five-grade evaluation was performed in each item, and when a style has not less than 4 grade in all items, the style was evaluated as acceptable.

Criterion for Evaluation

5: Excellent
4: Good
3: Moderate
2: Poor
1: Very poor (Method for Evaluating Blow Property)

In the method for evaluating blow property (heat resistance), five common engineers engaged in cosmetics evaluation of wigs etc. evaluated a sample for points of curling of hair ends and welding, using a commercially available hair drier (120 degrees C. to 140 degrees C.), in a same manner as in the method for evaluating stylability. The evaluations were integrated, five-grade evaluation shown hereinafter was performed, and a point of not less than 4 was considered to be acceptable.

5: Breakage on hair not observed at all
4: Almost no breakages on hair observed
3: Breakage on hair as a curl observed for a part of hair ends
2: Breakage on hair as curl and welding of hair ends observed
1: Heavy breakage on almost all hair ends of curl and welding observed

EXAMPLE 1

An acrylic polymer resin comprising acrylonitrile 52% by weight, vinyl chloride 4% by weight, vinylidene chloride 42.6% by weight, and sodium styrene sulfonate 1.4% by weight had a content of acrylonitrile of 66 mol %, a sulfur content originating in vinyl based monomer including a sulfonic group of 0.22% by weight, and a specific viscosity of 0.26. The resin was dissolved in acetone to obtain a spinning solution prepared so as to have a resin concentration of 26.0% by weight. The spinning solution had a viscosity of 55 poises. Using a nozzle with a non-circular cross section having a shape of "∈" (0.3 mm of pore size, 25 numbers of holes) under a condition of nozzle draft of 0.90, the spinning solution was extruded in an aqueous solution having an acetone concentration of 36% by weight, and a temperature of 25 degrees C.

Moreover, a yarn extruded was led to a washing water bath at 50 degrees C. to 60 degrees C., stretched 1.93 times while being washed with water, and subsequently, was dried at a drying temperature of 125 degrees C., and a wet-bulb temperature of 70 degrees C., to recover lost transparency. After hot-stretched by 2.0 times, the yarn was furthermore heat treated at 160 degrees C. and relaxed by 8%. An acrylic synthetic fiber having a single yarn size of 51 decitexes was obtained.

Thus obtained acrylic synthetic fiber had a cross section shape of almost round shape, and had a knot-like unevenness on a surface thereof, a difference of distances between a depression and a projection of 7.0 micrometers and a distance between peaks of unevenness of 0.25 mm. Moreover, the yarn had a flexural rigidity value of $7.5\times10^{-7}$ $N\text{-}m^2/m$, a torsional rigidity value of $5.0\times10^{-9}$ $N\text{-}m^2$, and a 10% shrinkage starting temperature (T10) of 156 degrees C. A pageboy style was formed using the acrylic synthetic fiber to perform evaluation. Table 1 shows results. FIG. 1 is a photograph showing a surface unevenness of an acrylic synthetic fiber 1 in Example 1. The fiber has a a knot-like unevenness on a surface thereof. VC represents vinyl chloride in the Table 1, and VD represents vinylidene chloride.

EXAMPLE 2

An acrylic polymer resin comprising acrylonitrile 63% by weight, vinylidene chloride 35.5% by weight, and sodium styrene sulfonate 1.5% by weight had a content of acrylonitrile of 76 mol %, a sulfur content originating in the vinyl based monomer including a sulfonic group of 0.23% by weight, and a specific viscosity of 0.40. The resin was dissolved in dimethylacetamide to obtain a spinning solution prepared so as to have a resin concentration of 20.0% by weight. The spinning solution had a viscosity of 70 poises. Using a nozzle with a circular cross section (0.3 mm of pore size, 25 numbers of holes) under a condition of nozzle draft of 0.81, the spinning solution was extruded in an aqueous solution having a dimethylacetamide concentration of 60% by weight, and a temperature of 25 degrees C. Moreover, a yarn extruded was led to a washing water bath at 50 degrees C. to 60 degrees C., stretched 1.93 times while being washed with water, and subsequently, was dried at a drying temperature of 125 degrees C., and a wet-bulb temperature of 70 degrees C., to recover lost transparency. After hot-stretched by 2.5 times, the yarn was furthermore heat treated at 160 degrees C. and relaxed by 8%. An acrylic synthetic fiber having a single yarn size of 51 decitexes was obtained.

Thus obtained acrylic synthetic fiber had a cross section shape of almost round shape, and had a knot-like unevenness on a surface thereof, a difference of distances between a depression and a projection of 8.0 micrometers and a distance between peaks of unevenness of 0.27 mm. Moreover, the yarn had a flexural rigidity value of $8.4\times10^{-7}$ $N\text{-}m^2/m$, a torsional rigidity value of $9.2\times10^{-9}$ $N\text{-}m^2$, and a 10% shrinkage starting temperature (T10) of 165 degrees C. Evaluation was performed in a same manner as in Example 1 for the acrylic synthetic fiber. Table 1 shows results.

Comparative Example 1

An acrylic polymer resin comprising acrylonitrile 48% by weight, vinyl chloride 51% by weight, and sodium styrene sulfonate 1.0% by weight had a content of acrylonitrile of 53 mol %, a sulfur content originating in vinyl based monomer including a sulfonic group of 0.16% by weight, and a specific viscosity of 0.18. The resin was dissolved in acetone to obtain a spinning solution prepared so as to have a resin concentration of 29.0% by weight. The spinning solution had a viscosity of 40 poises. Using a nozzle with a non-circular cross section having a shape of "∈" (0.3 mm of pore size, 25 numbers of holes) under a condition of nozzle draft of 0.80, the spinning solution was extruded in an aqueous solution having an acetone concentration of 38% by weight, and a temperature of 25 degrees C. Moreover, a yarn extruded was led to a washing water bath at 50 degrees C. to 60 degrees C., stretched 1.9 times while being washed with water, and subsequently, was dried at a drying temperature of 125 degrees C., and a wet-bulb temperature of 70 degrees C., to recover lost transparency. After hot-stretched by 2.0 times, the yarn was furthermore heat treated at 160 degrees C. and relaxed by 8%. An acrylic synthetic fiber having a single yarn size of 53 decitexes was obtained.

Figure 2:
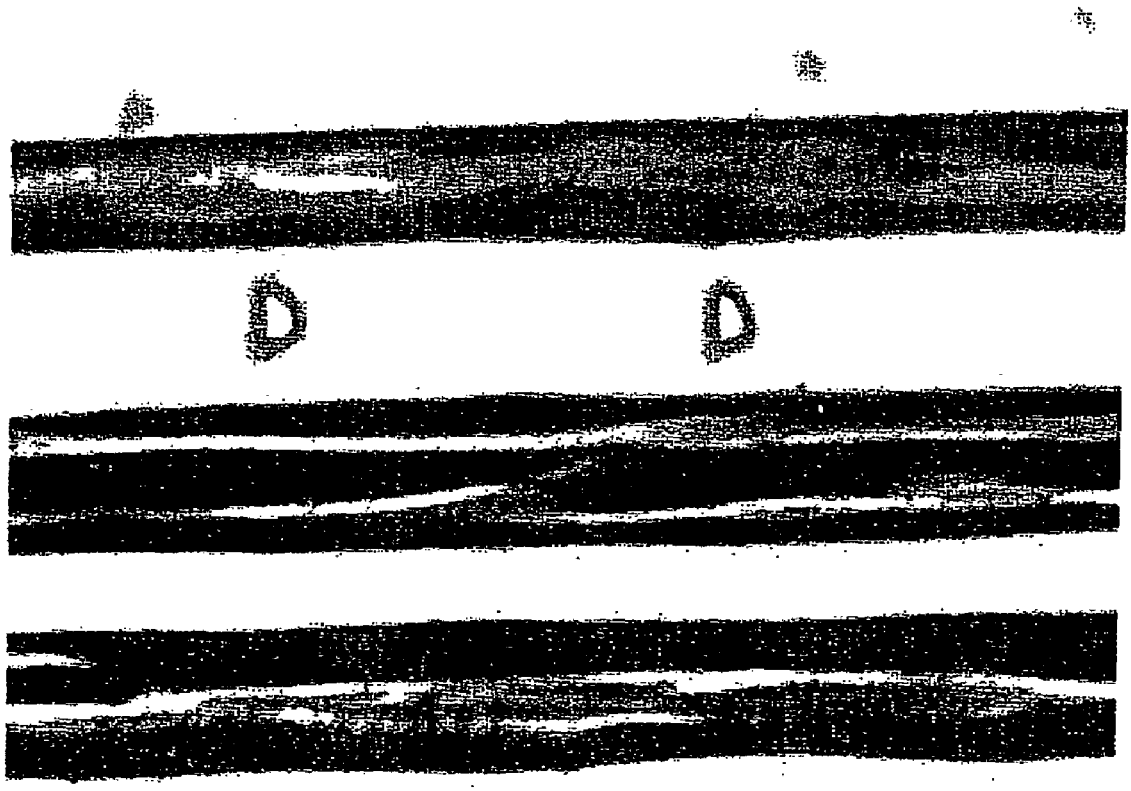
FIG. 2 is a photograph showing a surface unevenness of an acrylic synthetic fiber in Comparative Example 1.

Thus obtained acrylic synthetic fiber had a cross section shape of almost round shape, and had a knot-like unevenness on a surface thereof, a difference of distances between a depression and a projection of 5.5 micrometers and a distance between peaks of unevenness of 0.30 mm. Moreover, the yarn had a flexural rigidity value of $6.5\times10^{-7}$ N-m$^2$/m, a torsional rigidity value of $4.7\times10^{-9}$ N-m$^2$, and a 10% shrinkage starting temperature (T10) of 138 degrees C. Evaluation was performed in a same manner as in Example 1 for the acrylic synthetic fiber. Table 1 shows results. FIG. 2 is a photograph showing a surface unevenness of the acrylic synthetic fiber 2 in Comparative Example 1. The fiber had a knot-like unevenness on a surface thereof.

Comparative Example 2

An acrylic polymer resin comprising acrylonitrile 48% by weight, vinyl chloride 51.5% by weight, and sodium styrene sulfonate 0.5% by weight had a content of acrylonitrile of 53 mol %, a sulfur content originating in vinyl based monomer including a sulfonic group of 0.078% by weight, and a specific viscosity of 0.17. The resin was dissolved in acetone to obtain a spinning solution prepared so as to have a resin concentration of 28.0% by weight. The spinning solution had a viscosity of 45 poises. Using a nozzle with a circular cross section (0.3 mm of pore size, 25 numbers of holes) under a condition of nozzle draft of 0.82, the spinning solution was extruded in an aqueous solution having an acetone concentration of 20% by weight, and a temperature of 25 degrees C. Moreover, a yarn extruded was led to a washing water bath at 50 degrees C. to 60 degrees C., stretched 1.9 times while being washed with water, and subsequently, was dried at a drying temperature of 125 degrees C., and a wet-bulb temperature of 70 degrees C., to recover lost transparency. After hot-stretched by 2.0 times, the yarn was furthermore heat treated at 160 degrees C. and relaxed by 8%. An acrylic synthetic fiber having a single yarn size of 53 decitexes was obtained.

Although the acrylic synthetic fiber thus obtained had a horseshoe shape cross-section, it did not have unevenness on a surface thereof. Moreover, the yarn had a flexural rigidity value of $6.5\times10^{-7}$ N-m$^2$/m, a torsional rigidity value of $4.5\times10^{-9}$ N-m$^2$, and a 10% shrinkage starting temperature (T10) of 138 degrees C. Evaluation was performed in a same manner as in Example 1 for the acrylic synthetic fiber. Table 1 shows results.

Comparative Example 3

An acrylic polymer resin comprising acrylonitrile 52% by weight, vinyl chloride 4% by weight, vinylidene chloride 42.6% by weight and sodium styrene sulfonate 1.4% by weight had a content of acrylonitrile of 66 mol %, a sulfur content originating in the vinyl based monomer including a sulfonic group of 0.22% by weight, and a specific viscosity of 0.26. The resin was dissolved in acetone to obtain a spinning solution prepared so as to have a resin concentration of 26.0% by weight. The spinning solution had a viscosity of 55 poises. Using a nozzle with a non-circular cross section having a shape of∈(0.4 mm of pore size, 25 numbers of holes) under a condition of nozzle draft of 1.30, the spinning solution was extruded in an aqueous solution having an acetone concentration of 25% by weight, and a temperature of 25 degrees C. Moreover, a yarn extruded was led to a washing water bath at 50 degrees C. to 60 degrees C., stretched 2.0 times while being washed with water, and subsequently, was dried at a drying temperature of 125 degrees C., and a wet-bulb temperature of 70 degrees C., to recover lost transparency. After hot-stretched by 2.4 times, the yarn was furthermore heat treated at 160 degrees C. and relaxed by 8%. An acrylic synthetic fiber having a single yarn size of 51 decitexes was obtained.

Figure 3:
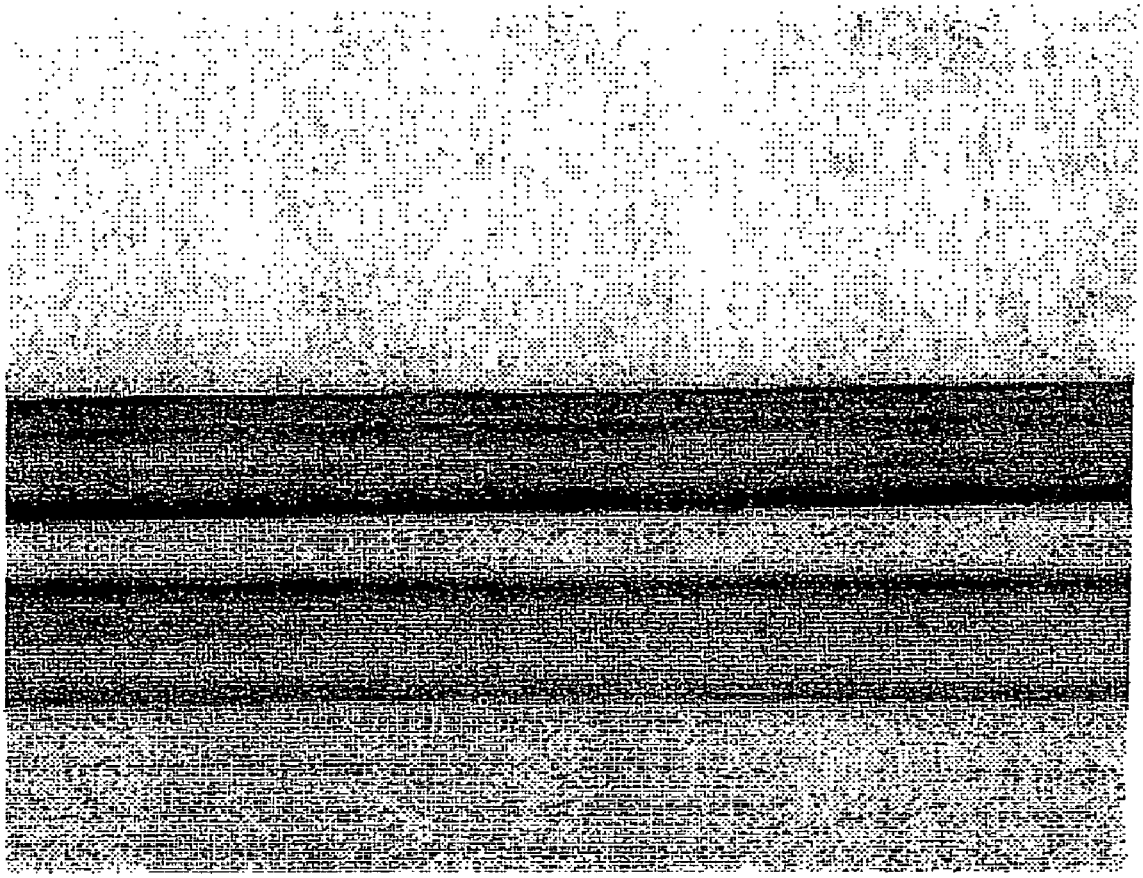
FIG. 3 is a photograph showing a surface of an acrylic synthetic fiber in Comparative Example 3.

Although the acrylic synthetic fiber thus obtained had an almost round shape, it did not have unevenness on a surface thereof. Moreover, the yarn had a flexural rigidity value of $7.5\times10^{-7}$ N-m$^2$/m, a torsional rigidity value of $5.0\times10^{-9}$ N-m$^2$, and a 10% shrinkage starting temperature (T10) of 156 degrees C. Evaluation was performed in a same manner as in Example 1 for the acrylic synthetic fiber. Table 1 shows results. FIG. 3 is a photograph showing a surface unevenness of the acrylic synthetic fiber 3 in Comparative Example 3. Knot-like unevenness was not observed on a surface of the fiber.

TABLE 1

| | Monomer content in polymer | | | | Unevenness | |
|---|---|---|---|---|---|---|
| | Acrylo-nitrile | Vinyl monomer including halogen wt % | Sulfur content originating in vinyl based monomer including a sulfonic group wt % | Specific viscosity | Difference micrometer | Distance mm |
| Example 1 | 66 mol % (52 wt %) | VC4 VD 42.6 | 0.22 | 0.26 | 7.0 | 0.25 |
| Example 2 | 76 mol % (63 wt %) | VD 35.5 | 0.23 | 0.40 | 8.0 | 0.27 |

TABLE 1-continued

| | | | | | | |
|---|---|---|---|---|---|---|
| Comparative Example 1 | 53 mol % (48 wt %) | VC 51.0 | 0.16 | 0.18 | 5.5 | 0.30 |
| Comparative Example 2 | 53 mol % (48 wt %) | VC 51.5 | 0.078 | 0.17 | 0 | 0 |
| Comparative Example 3 | 66 mol % (52 wt %) | VC4 VD 42.6 | 0.22 | 0.26 | 0 | 0 |

| | Rigidity | | | Syllabicity | | | | |
|---|---|---|---|---|---|---|---|---|
| | Flexural × $10^{-7}$ (N − $m^2$/m) | Torsional × $10^{-9}$ (N − $m^2$) | $T_{10}$ | Curl retentivity | Curl stability | Bulkiness | Set of surface | Blow property |
| Example 1 | 7.5 | 5.0 | 156 | 5 | 5 | 5 | 5 | 4 |
| Example 2 | 8.4 | 9.2 | 165 | 4 | 5 | 4 | 5 | 5 |
| Comparative Example 1 | 6.5 | 4.7 | 138 | 4 | 4 | 2 | 5 | 3 |
| Comparative Example 2 | 6.5 | 4.5 | 138 | 4 | 3 | 4 | 3 | 2 |
| Comparative Example 3 | 7.5 | 5.0 | 156 | 5 | 3 | 5 | 5 | 4 |

(Note)
wt % = % by weight,
Mol % = mol %,
Part = part by weight

As Table 1 shows clearly, Examples 1 and 2 have excellent stylability and excellent blow property (heat resistance).

INDUSTRIAL APPLICABILITY

The present invention provides an artificial hair comprising an acrylic synthetic fiber having excellent stylability and heat resistance, the acrylic synthetic fiber having a knot-like unevenness on a fiber surface thereof, a difference of distances between a depression and a projection of 5.0 micrometers to 15.0 micrometers, a distance between peaks of unevenness of 0.05 mm to 0.5 mm, a flexural rigidity value of the fiber of $7.0\times10^{-7}$ N-$m^2$/m to $10.0\times10^{-7}$ N-$m^2$/m, and a torsional rigidity value of the fiber of $5.0\times10^{-9}$ N-$m^2$ to $10.0\times10^{-9}$ N-$m^2$.

The invention claimed is:

1. An acrylic synthetic fiber having a knot-like unevenness on a fiber surface thereof, a difference of distances between a depression and a projection of 5.0 micrometers to 15.0 micrometers, a distance between peaks of unevenness of 0.05 mm to 0.5 mm, a flexural rigidity value of the fiber of $7.0\times10^{-7}$ N-$m^2$/m to $10.0\times10^{-7}$ N-$m^2$/m, and a torsional rigidity value of the fiber of $5.0\times10^{-9}$ N-$m^2$ to $10.0\times10^{-9}$ N-$m^2$.

2. The acrylic synthetic fiber according to claim 1 comprising an acrylic copolymer having a content of acrylonitrile of not less than 60 mol %, a sulfur content originating in a vinyl based monomer including a sulfonic group of 0.15% by weight to 0.50% by weight, and a specific viscosity of 0.20 to 0.50.

3. The acrylic synthetic fiber according to claim 1, wherein a 10% shrinkage starting temperature of the acrylic synthetic fiber is not less than 150 degrees C.

4. An artificial hair comprising the acrylic synthetic fiber according to claim 1.

5. The acrylic synthetic fiber according to claim 2, wherein a 10% shrinkage starting temperature of the acrylic synthetic fiber is not less than 150 degrees C.

6. An artificial hair comprising the acrylic synthetic fiber according to claim 2.

7. An artificial hair comprising the acrylic synthetic fiber according to claim 3.

* * * * *

UNITED STATES PATENT AND TRADEMARK OFFICE

CERTIFICATE OF CORRECTION

PATENT NO. : 7,135,225 B2
APPLICATION NO. : 10/522759
DATED : November 14, 2006
INVENTOR(S) : Yoshimura et al.

It is certified that error appears in the above-identified patent and that said Letters Patent is hereby corrected as shown below:

In the cover page, under (54): Change "STYLEABILITY" to --STYLABILITY--.

| Column | Line | |
|---|---|---|
| 1 | 2 | Change "STYLEABILITY" to --STYLABILITY--. |
| 6 | 45 | Change "viscisity" to --viscosity--. |
| 8 | 1 | Change "shape of "∈"(0.3 mm" to --shape of "*" (0.3 mm--. |
| 9 | 12 | Change "shape of "∈" (0.3 mm" to --shape of "*" (0.3 mm--. |
| 10 | 31 | Change "shape of ∈(0.4 mm" to --shape of * (0.4 mm-- |

.

Signed and Sealed this

Thirteenth Day of March, 2007

JON W. DUDAS
*Director of the United States Patent and Trademark Office*